US009410413B2

(12) United States Patent
O'Brien

(10) Patent No.: US 9,410,413 B2
(45) Date of Patent: Aug. 9, 2016

(54) WELL SYSTEM WITH ANNULAR SPACE AROUND CASING FOR A TREATMENT OPERATION

(71) Applicant: Robert S. O'Brien, Katy, TX (US)

(72) Inventor: Robert S. O'Brien, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 193 days.

(21) Appl. No.: 14/057,217

(22) Filed: Oct. 18, 2013

(65) Prior Publication Data

US 2015/0107836 A1 Apr. 23, 2015

(51) Int. Cl.

| | |
|---|---|
| ***E21B 43/267*** | (2006.01) |
| ***E21B 43/11*** | (2006.01) |
| ***E21B 43/26*** | (2006.01) |
| ***E21B 43/10*** | (2006.01) |

(52) U.S. Cl.

CPC ..... *E21B 43/261* (2013.01); *E21B 43/10* (2013.01); *E21B 43/11* (2013.01); *E21B 43/267* (2013.01)

(58) Field of Classification Search

CPC ..... E21B 43/261; E21B 43/10; E21B 43/11; E21B 43/267

See application file for complete search history.

(56) References Cited

U.S. PATENT DOCUMENTS

| | | | | |
|---|---|---|---|---|
| 2,193,775 | A * | 3/1940 | Stratford | 166/278 |
| 3,044,547 | A * | 7/1962 | Jarboe, Jr. | 166/276 |
| 3,368,623 | A * | 2/1968 | Carter et al. | 166/276 |
| 3,880,233 | A * | 4/1975 | Muecke et al. | 166/205 |
| 5,287,923 | A * | 2/1994 | Cornette et al. | 166/278 |
| 5,320,178 | A * | 6/1994 | Cornette | 175/19 |
| 6,543,545 | B1 * | 4/2003 | Chatterji et al. | 166/381 |
| 7,322,412 | B2 * | 1/2008 | Badalamenti et al. | 166/285 |
| 7,461,699 | B2 * | 12/2008 | Richard et al. | 166/376 |
| 7,503,399 | B2 * | 3/2009 | Badalamenti et al. | 166/386 |
| 7,527,103 | B2 * | 5/2009 | Huang et al. | 166/311 |
| 7,621,336 | B2 * | 11/2009 | Badalamenti et al. | 166/332.8 |
| 7,621,337 | B2 * | 11/2009 | Badalamenti et al. | 166/332.8 |
| 7,762,342 | B2 * | 7/2010 | Richard et al. | 166/376 |
| 8,646,523 | B2 * | 2/2014 | Huang et al. | 166/100 |
| 8,783,365 | B2 * | 7/2014 | McCoy et al. | 166/373 |
| 9,033,044 | B2 * | 5/2015 | Huang | 166/308.1 |
| 9,033,055 | B2 * | 5/2015 | Mccoy et al. | 166/373 |
| 2003/0131997 | A1 * | 7/2003 | Chatterji et al. | 166/278 |
| 2004/0231845 | A1 * | 11/2004 | Cooke, Jr. | 166/279 |
| 2005/0092363 | A1 * | 5/2005 | Richard | E21B 37/06 137/73 |
| 2006/0042798 | A1 * | 3/2006 | Badalamenti et al. | 166/285 |
| 2008/0060803 | A1 * | 3/2008 | Badalamenti et al. | 166/242.8 |
| 2008/0060813 | A1 * | 3/2008 | Badalamenti et al. | 166/316 |
| 2008/0087416 | A1 * | 4/2008 | Badalamenti et al. | 166/88.1 |
| 2008/0196896 | A1 * | 8/2008 | Bustos et al. | 166/281 |
| 2008/0296024 | A1 * | 12/2008 | Huang et al. | 166/311 |
| 2009/0078408 | A1 * | 3/2009 | Richard et al. | 166/227 |
| 2011/0094742 | A1 * | 4/2011 | Badalamenti et al. | 166/285 |
| 2011/0220361 | A1 * | 9/2011 | Huang | 166/308.1 |
| 2011/0220362 | A1 * | 9/2011 | Huang et al. | 166/308.1 |

* cited by examiner

*Primary Examiner* — Catherine Loikith
*Assistant Examiner* — Crystal J Miller
(74) *Attorney, Agent, or Firm* — Cantor Colburn LLP

(57) ABSTRACT

In one aspect, a method for completing a wellbore in a formation is disclosed, that in one non-limiting embodiment includes placing a casing in the wellbore, cementing an annulus between the casing and the wellbore, and forming an annular cavity of a selected length in the cement between the casing and the wellbore. In one aspect, the forming the annular space includes placing a dissolvable material on an outside of the casing before placing the casing in the wellbore, and dissolving the dissolvable material after cementing to form the annular space.

15 Claims, 2 Drawing Sheets

WELL SYSTEM WITH ANNULAR SPACE AROUND CASING FOR A TREATMENT OPERATION

BACKGROUND

1. Field of the Disclosure

This disclosure relates generally to apparatus and methods for completing a wellbore for the production of hydrocarbons from subsurface formations, including fracturing selected formation zones in a wellbore, sand packing and flooding a formation with a fluid.

2. Background of the Art

Wellbores are drilled in subsurface formations for the production of hydrocarbons (oil and gas). Modern wells can extend to great well depths, often more than 1500 meters (about 15,000 ft.). Hydrocarbons are trapped in various traps in the subsurface formations at different depths. Such sections of the formation are referred to as reservoirs or hydrocarbon-bearing formations or zones. Some formations have high mobility, which is a measure of the ease of the hydrocarbons flow from the reservoir into a well drilled through the reservoir under natural downhole pressures. Some formations have low mobility and the hydrocarbons trapped therein are unable to move with ease from the reservoir into the well. Stimulation methods are typically employed to improve the mobility of the hydrocarbons through the reservoirs. One such method, referred to as fracturing (also referred to as "fracing" or "fracking"), is often utilized to create cracks in the reservoir to enable the fluid from the formation (formation fluid) to flow from the reservoir into the wellbore. To fracture multiple zones, an assembly containing an outer string with an inner string therein is run in or deployed in the wellbore. The outer string typically includes a screen placed proximate to the perforations. The inner string includes a crossover. To fracture a formation, a fluid is supplied under pressure from the inner string to the formation via the annular space between the screen and the casing through the perforations. Typically a certain minimum width of the annular space is required for the proper flow of the fluid through the perforations, which may be of the order of one half of an inch or more. The screen is left in the casing after fracturing for flow of reservoir fluid into the casing. The fracturing fluid typically contains a proppant, such as sand, which is corrosive to the screen. Also, it is desirable to reduce the width of the annular space so as to have as increased inside diameter of the casing for production of hydrocarbons from the reservoir.

The disclosure herein, in one aspect, provides an annular space outside of the casing for supplying treatment fluid to the formation, substantially bypassing the screen.

SUMMARY

In one aspect, an apparatus for use in a wellbore is disclosed that in one non-limiting embodiment includes A flow control device for use in a wellbore is disclosed that in one non-limiting embodiment may include a main flow passage and a weep hole, wherein the main flow passage closes when a fluid is supplied to a first end of the valve that exceeds a selected rate and opens when the fluid supplied is below the selected rate and wherein the weep hole continues to allow the fluid therethrough.

In another aspect a wellbore system is disclosed that, in one non-limiting embodiment, includes a casing in the wellbore, cement disposed between the wellbore and the casing, an annular space of a selected length in the cement between the casing and the wellbore, and perforations through the casing, cement and formation. In one aspect, the annular space is formed by dissolving a dissolvable material placed over an outside of the casing.

Examples of the more important features of a well treatment system and methods that have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

In one aspect, a wellbore system is disclosed that provides an annular space (also referred to herein as a flow area or cavity) in the cement around a casing that may be utilized to supply a treatment fluid to perform a wellbore operation, including, but not limited to, fracturing (also referred to herein as fracing or fracking), and flooding a formation. The annular space enables to inject a treatment fluid into the formation without flowing such fluid over sand screens typically deployed proximate to the perforations inside the casing, which enables placing the screen closer to the inside of the casing, thereby providing increased inner diameter of the screens because the treatment fluid flow is directed to outside the casing. In one aspect, a dissolvable material of certain width or thickness may be placed or wrapped on the outer side of the casing along a section or selected length that be perforated. The casing with the dissolvable material is then deployed in the wellbore and the annular space between the casing and the wellbore cemented. Perforations are performed through the casing, dissolvable material, cement and the formation. A suitable fluid may then be supplied to perforations to dissolve the dissolvable material, which creates the annular space (cavity) around the casing. Typically, a screen is installed inside the casing to perform treatment operations, wherein the treatment fluid is supplied to the formation via the space between the screen and the perforated casing. The annular space enables installing the screen very close to the casing as such space is no longer utilized to supply the treatment fluid to the formation, which provides increased diameter for the installation of a production string in the wellbore for the production of fluid (including hydrocarbons) from the formation.

Figure 1:
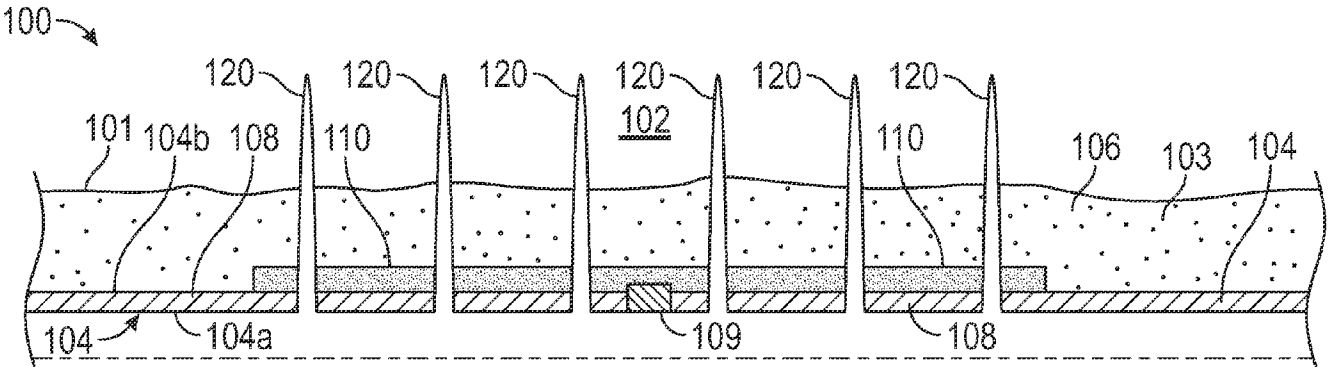
FIG. 1 shows an exemplary wellbore lined with casing having a dissolvable material on an outside section of the casing, wherein the wellbore has been cemented and perforated, according to one non-limiting embodiment of the disclosure.

FIG. 1 is a line diagram of a section of a wellbore system 100 that is shown to include a wellbore 101 formed in formation 102 for performing a treatment operation therein, such as fracturing the formation (also referred to herein as fracing or fracking), gravel packing, flooding, etc. The wellbore 101 is lined with a casing 104, which may be made by joining pipe sections 108 with connections 109, known in the art. The casing 104 is lined on its outer side or outer diameter (OD) with a dissolvable material 110, suitable for downhole use, along a selected length of the casing 104. In one aspect, the material 110 may be dissolved by supplying a fluid, such as a fluid containing acid or another suitable material, or a hot aqueous solution or water. The dissolvable material 110 may be applied along the length of the casing that will be perforated. Once the casing 104 is placed in the wellbore 101, the space 103 (annulus) between the wellbore 101 and the casing 104 is filled with cement 106. After cementing, a length of the casing is perforated with perforations 120 that extend from the casing inside 104*a* into the formation 102 via the dissolvable material 110 and cement 106.

Figure 2:
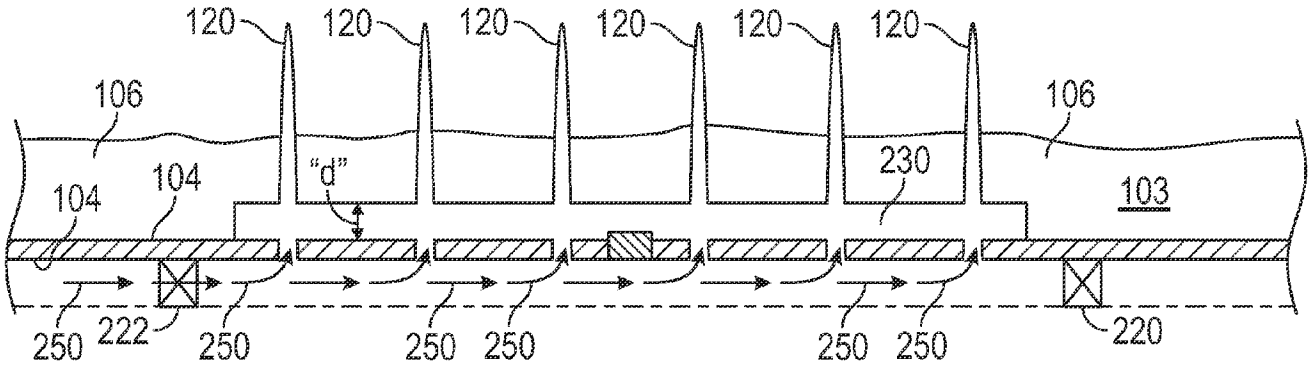
FIG. 2 shows the wellbore of FIG. 1 after the dissolvable material has been removed to form an annular flow space or cavity in the cement along a length of the casing.

FIG. 2 shows a process of dissolving the dissolvable material 110. Prior to dissolving the material 110, a lower packer 220 may be deployed to isolate the wellbore 101 below the perforations 120. Another packer 222 may be placed above the perforations 120. To dissolve material 110, a suitable fluid 250 may be supplied through the packer 222 to the perforation 120, causing the material 110 to dissolve. Dissolving the material 110 creates an annular space (or cavity) 230 between the casing 104 and the wellbore 101 along a selected length. In one aspect, the depth of the cavity ("d") may be designed so that it provides sufficient radial space outside the casing 104 to inject a treatment fluid into the perforations 120 in the formation 102 to fracture the formation, as described below FIG. 3. In one aspect, the depth "d" may be about one half of an inch.

Figure 3:
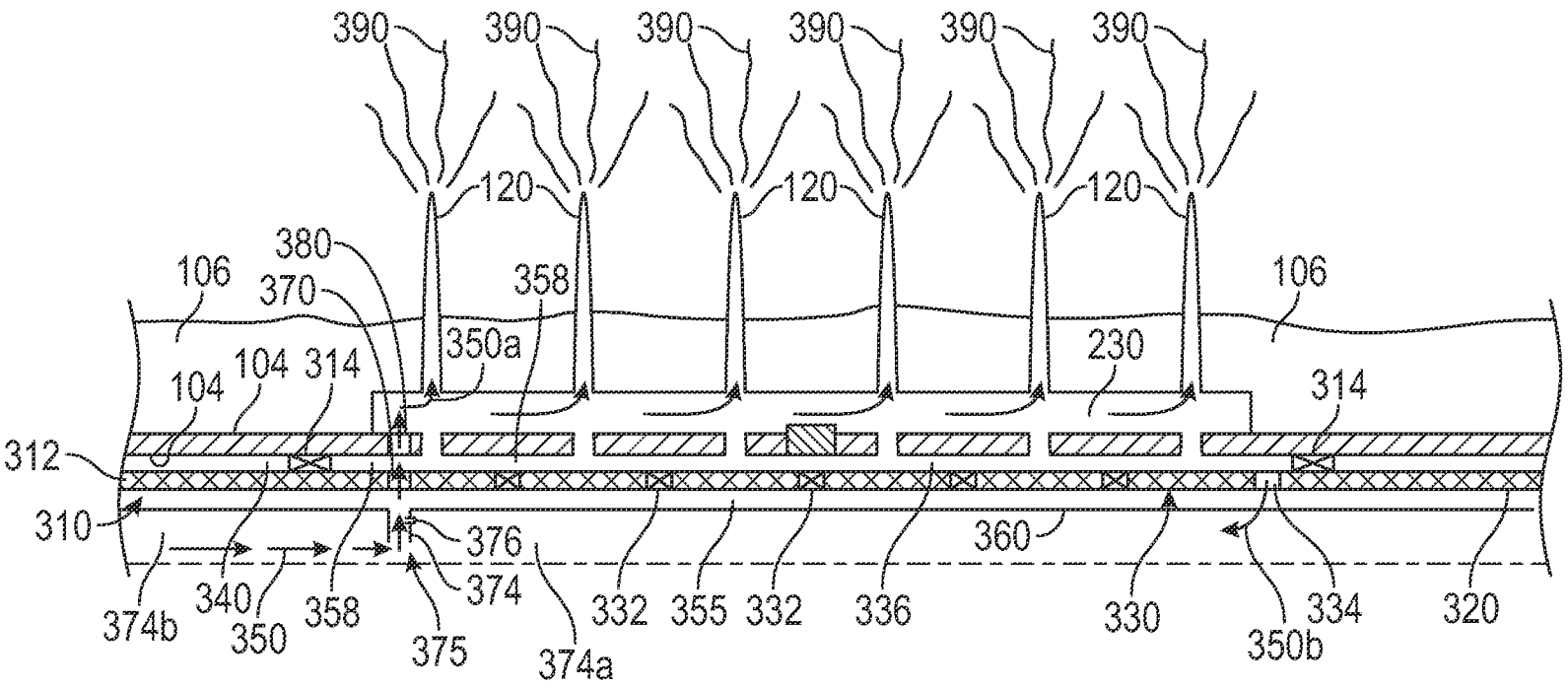
FIG. 3 shows the wellbore of FIG. 2, with an assembly deployed proximate to the perforated section for performing a treatment operation, according to one non-limiting embodiment of the disclosure.

FIG. 3 shows the wellbore system of FIG. 2 configured for performing a treatment operation via the annular space 230, according to one embodiment of the disclosure. To perform a treatment operation an assembly 310 is deployed in the wellbore 102, which may include an outer string 320 and an inner string 360 placed inside the outer string 320. The outer string 320, in one non-limiting embodiment, includes a sand screen 330 on a conveying member 312, such as a tubing. The screen 330 may further include one or more flow devices, such as valves 332, and a monitoring valve 334. The outer string 320 also includes packer 314 above and below the screen 330 to isolate space 358 between the outer string 320 and the casing 104. The inner string 360 includes a cross-over tool 374 that has a flow passage 375 from the inner string 360 to the outer string 320 and a relatively narrow passage 376 through the crossover tool 374 to provide fluid communication between space 374*a* below the crossover tool 374 and annulus 355 between the outer string 320 and the inner string 360. The screen 330 also includes a flow passage (also referred to as frac port) 370 that provides a flow passage from inside the outer string 320 to the annular space 358 between the outer sting 320 and the casing 104. A flow device or passage 380 is provided in the casing proximate to the flow passage 370 in the screen 330. In this configuration, valves 332 are closed while the monitoring valve 334 is open.

To perform a treatment operation, valves 370 and 380 are opened. The packers 314 are deployed to isolate or seal space 358 between screen 330 and the casing 104. A treatment fluid 350 is supplied under pressure to the inner string, which fluid is injected into the annular space 230 via passage 375, valve 370 and valve 380. Most of the fluid supplied flows from the inner string 360 into the annular space 230 via valves 370 and 380, as shown by arrows 350*a*. A relatively small amount of the treatment fluid 350 may flow through perforations in the casing 104 as the space 336 is relatively narrow compared to the annular space 230. The fluid 350 creates fractures 390 in the formation 102 via perforations 120. In one aspect, the treatment fluid 350 may include a proppant, such as sand. In such a case, the proppant packs or fills the fractures 390, perforations 120 and space 336 between the screen 330 and casing 104. Flow passage 334 provides a return path for the fluid 350 from the space 336 and from the formation 102 via sand screen 330, as shown by arrow 350*b*. Once the treatment operation is completed, valves 332 are opened and the inner string 360 is pulled out of the wellbore 101. A production string (not shown), known in the art, is installed to enable fluid from the formation 102 to flow into the production string for retrieval of the formation fluid to the surface via screen 330 and valves 332.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method for completing a wellbore in a formation, comprising:

placing a casing in the wellbore, the casing including a casing flow valve;

cementing an annulus between the casing and the wellbore;

creating perforations in the casing, cement and formation;

forming an annular space of a selected length in the cement between the casing and the wellbore;

placing a string in the casing so that a string flow valve of the string is proximate to the casing flow valve; and supplying a treatment fluid under pressure from inside the string into the annular space via the string flow valve and the casing flow valve to inject the treatment fluid into the formation, wherein the treatment fluid substantially bypasses the perforations in the casing.

2. The method of claim 1, wherein forming the annular space comprises:

placing a dissolvable material on an outside of the casing before placing the casing in the wellbore; and dissolving the dissolvable material after creating the perforations by supplying a dissolving fluid to the perforations.

3. The method of claim 1, wherein the treatment fluid is selected from a group consisting of: (i) a base fluid with a proppant; (ii) a fluid containing acid; (iii) an aqueous solution; and (iv) water.

4. The method of claim 1, wherein the string includes a screen placed adjacent to the perforations in the casing, the screen including screen valves proximate the perforations;

supplying the fluid under pressure into the annular space with the screen valves closed.

5. The method of claim 4 further comprising opening the screen valves to allow flow of a fluid from the formation into the wellbore via the screen.

6. A method for completing a wellbore in a formation, comprising:

placing a casing in the wellbore having a dissolvable material on an outside length of the casing, wherein the casing includes a casing flow valve;

cementing an annulus between the casing and the wellbore;

forming perforations through the casing, dissolvable material and the formation;

dissolving the dissolvable material to form an annular space between the casing and the cement;

placing an outer string in the casing so that an outer string flow valve of the outer string is proximate to the casing flow valve; and supplying a treatment fluid from inside the outer string into the annular space via the outer string flow valve and the casing flow valve to inject the treatment fluid into the formation to create fractures in the formation, wherein the treatment fluid substantially bypasses the perforations in the casing.

7. The method of claim 6, wherein the treatment fluid includes a base fluid and a proppant and wherein the method further comprises supplying the treatment fluid to create fractures in the formation and to fill the fractures with the proppant.

8. The method of claim 7 further comprising:

placing an inner string in the outer string within the casing, providing a flow path from the inner string into the annular space via the outer string; and supplying the treatment fluid into the annular space through the flow path.

9. The method of claim 6, wherein the outer string includes a screen placed adjacent to the perforations in the casing, further comprising providing flow passages through the screen after creating fractures to enable a fluid from the formation to flow into the casing via the perforations and the flow passages through the screen.

10. The method of claim 6, further comprising placing an inner string in the outer string, the inner string including a cross-over device that provides an inner string flow passage from the inner string to the outer string, and supplying the treatment fluid into the formation via the crossover device, the inner string flow passage, the outer string flow valve, the casing flow valve and the annular space.

11. The method of claim 6, wherein the treatment fluid is selected from a group consisting of: (i) a base fluid with a proppant; (ii) a fluid containing acid; (iii) an aqueous solution; and (iv) water.

12. A wellbore system, comprising:

a casing in a wellbore formed in a formation;

a cement disposed between the casing and the wellbore;

an annular space of a selected length in the cement between the casing and the wellbore;

perforations through the casing, cement and formation;

a casing flow valve in the casing for supplying a fluid from within the casing into the annular space;

a string including a string flow valve, wherein the string is placed in the casing so that the string flow valve is proximate the casing valve to allow treatment fluid from inside the string to flow into the annular space via the string flow valve and the casing flow valve while substantially bypassing the perforations in the casing.

13. The wellbore system of claim 12, wherein the annular space is formed by dissolving a dissolvable material placed over an outside of the casing after forming the perforations.

14. The wellbore system of claim 12 further comprising a sand control device in the casing adjacent to the perforations that allows a fluid to flow from the formation into the casing.

15. The wellbore system of claim 12 further comprising fractures created in the formation by supplying a fluid under pressure to the formation via the annular space.

* * * * *